US008962232B2

(12) United States Patent
Sensui

(10) Patent No.: US 8,962,232 B2
(45) Date of Patent: Feb. 24, 2015

(54) PRODUCTION PROCESS OF POLYMERIZED TONER

(75) Inventor: Keita Sensui, Tokyo (JP)

(73) Assignee: Zeon Corporation, Tokyo (JP)

( * ) Notice: Subject to any disclaimer, the term of this patent is extended or adjusted under 35 U.S.C. 154(b) by 1005 days.

(21) Appl. No.: 12/744,003

(22) PCT Filed: Nov. 11, 2008

(86) PCT No.: PCT/JP2008/070489

§ 371 (c)(1),
(2), (4) Date: May 20, 2010

(87) PCT Pub. No.: WO2009/069462

PCT Pub. Date: Jun. 4, 2009

(65) Prior Publication Data

US 2010/0248132 A1 Sep. 30, 2010

(30) Foreign Application Priority Data

Nov. 30, 2007 (JP) ..... 2007-310709

(51) Int. Cl.
*G03G 9/08* (2006.01)

(52) U.S. Cl.
CPC ..... *G03G 9/0806* (2013.01)
USPC ..... 430/137.15; 430/137.16; 430/137.17

(58) Field of Classification Search
CPC ..... G03G 9/0806; G03G 9/08706; G03G 9/08708; G03G 9/08711; G03G 9/08713; G03G 9/08715; G03G 9/08731; G03G 9/0872; G03G 9/08722; G03G 9/08724; G03G 9/08726; G03G 9/8728; G03G 9/0802
USPC ..... 430/137.1, 137.11, 137.12, 137.13, 430/137.14, 137.15, 137.16, 137.17, 430/137.18, 137.19
See application file for complete search history.

(56) References Cited

U.S. PATENT DOCUMENTS 5,405,725 A 4/1995 Nakamura et al.
5,430,127 A * 7/1995 Kelly ..... 528/500

(Continued)

FOREIGN PATENT DOCUMENTS

JP 54-117589 A 9/1979
JP 5-100485 A 4/1993
JP 2002-258529 A 9/2002
JP 2003-525110 A 8/2003
JP 2004-4383 A 1/2004

(Continued)

OTHER PUBLICATIONS

International Search Report of PCT/JP2008/070489, mailing date of Dec. 16, 2008.

*Primary Examiner* — Christopher Rodee
*Assistant Examiner* — Omar Kekia
(74) *Attorney, Agent, or Firm* — Westerman, Hattori, Daniels & Adrian, LLP

(57) ABSTRACT

A production process of a polymerized toner composed of polymer particles, including a step of polymerizing a polymerizable monomer composition containing a colorant and a polymerizable monomer in the presence of a polymerization initiator in an aqueous dispersion medium, wherein, in a stripping treatment step, the dispersion containing the polymer particles is introduced into an evaporator to conduct the stripping treatment by a method, in which a gas is blown into the dispersion within the evaporator to discharge volatile organic components including an unreacted polymerizable monomer out of the evaporator concomitantly with the gas, and both inert gas and saturated steam are used as the gas blown into the dispersion.

12 Claims, 1 Drawing Sheet

(56) References Cited

U.S. PATENT DOCUMENTS

| | | | | |
|---|---|---|---|---|
| 5,476,745 | A | 12/1995 | Nakamura et al. | |
| 2003/0224276 | A1* | 12/2003 | Tsuji et al. | 430/109.3 |
| 2004/0014938 | A1 | 1/2004 | Taranti et al. | |
| 2004/0110081 | A1 | 6/2004 | Tanaka et al. | |
| 2005/0048392 | A1* | 3/2005 | Tanaka | 430/137.14 |
| 2007/0048645 | A1* | 3/2007 | Takashima et al. | 430/109.3 |
| 2008/0182189 | A1* | 7/2008 | Sensui | 430/108.2 |

FOREIGN PATENT DOCUMENTS

| | | | |
|---|---|---|---|
| JP | 2004-70247 | A | 3/2004 |
| JP | 2004-271816 | A | 9/2004 |
| JP | 2006-208624 | A | 8/2006 |
| JP | 2006-208657 | A | 8/2006 |
| JP | 2006-271816 | A | 10/2006 |
| JP | 2007-52039 | A | 3/2007 |
| JP | 2007-65426 | A | 3/2007 |

* cited by examiner

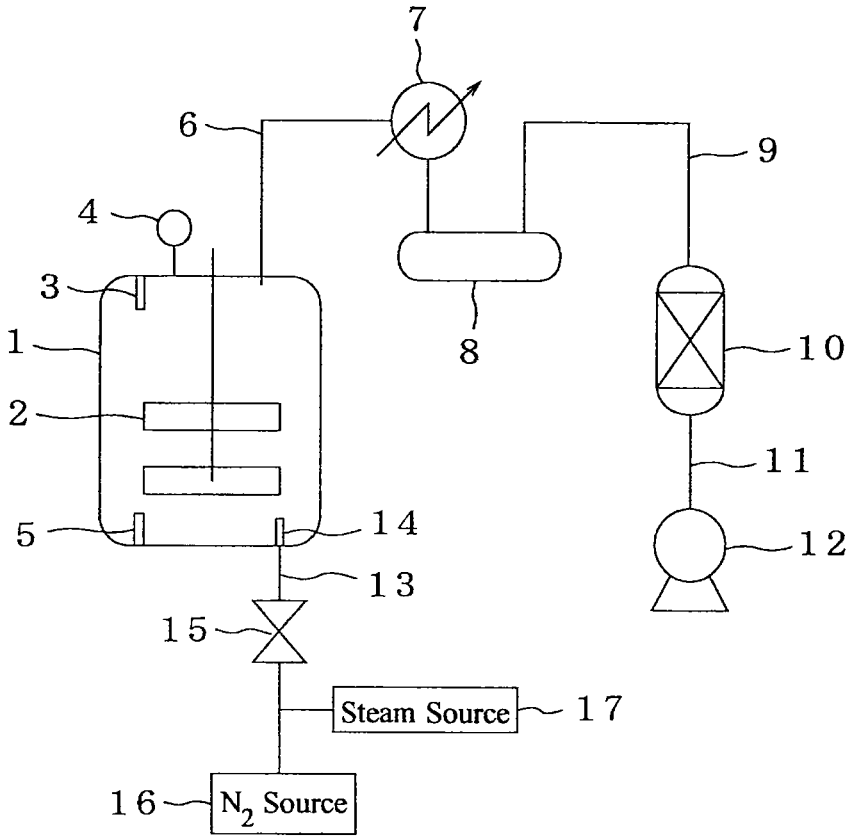
7
6
9
4
3
1
8
10
2
11
5
14
12
13
15
Steam Source
17
16
N2 Source

PRODUCTION PROCESS OF POLYMERIZED TONER

TECHNICAL FIELD

The present invention relates to a production process of a polymerized toner, and more particularly to a process for producing a polymerized toner, in which the content of total volatile organic components; TVOC) composed of unreacted polymerizable monomer(s) and other volatile organic compounds is markedly reduced by stably and efficiently subjecting polymer particles formed by polymerization of a polymerizable monomer composition to a stripping treatment, and which is excellent in toner properties.

BACKGROUND ART

In an image forming apparatus of an electrophotographic system (including an electrostatic recording system), such as a copying machine, laser beam printer or facsimile, a developer is used for making an electrostatic latent image formed on a photosensitive member visible. The developer comprises, as a main component, colored particles (toner) with a colorant, a charge control agent, a parting agent and the like dispersed in a binder resin.

The toner is roughly divided into a pulverized toner obtained by a pulverization process and a polymerized toner obtained by a polymerization process. In the pulverization process, a pulverized toner is obtained as colored resin powder by a process, in which a thermoplastic resin is melted and kneaded together with additive components such as a colorant, a charge control agent and a parting agent, and the resultant kneaded product is pulverized and classified. The thermoplastic resin used in the pulverization process is synthesized by polymerizing a polymerizable monomer in advance. On the other hand, in the polymerization process, a polymerized toner is obtained as colored polymer particles by a process, in which a polymerizable monomer composition containing a polymerizable monomer and additive components is polymerized in the presence of a polymerization initiator in an aqueous dispersion medium.

Even in any process, it is difficult to completely polymerize the polymerizable monomer in a polymerization step, and it is not avoided that an unreacted polymerizable monomer remains in the toner. The unreacted polymerizable monomer (hereinafter also referred to as "the remaining monomer") remaining in the toner causes such various problems that (1) the polymerizable monomer is vaporized out of the toner by heating upon fixing, or the like to worsen a working environment or emit offensive odor, (2) the toner undergoes blocking during its storage, (3) the flowability of the toner is deteriorated to lower the quality of an image formed with such a toner, (4) the toner is easy to cause offset, and (5) the toner is easy to cause toner filming on individual members in an image forming apparatus even though the amount thereof is slight.

The problems caused by the remaining monomer are more serious in the polymerized toner than the pulverized toner. In case of the pulverized toner, the content of the remaining monomer easily reduced by a heat treatment and a drying treatment in a preparation stage and a melting and kneading stage of the thermoplastic resin which will becomes a binder resin. On the other hand, in case of the polymerized toner, the remaining monomer must be removed from the polymer particles containing the additive components such as the colorant, charge control agent and parting agent. However, the remaining monomer is easy to be absorbed in these additive components, so that it is difficult to reduce the content of the remaining monomer compared with the case of the binder resin alone. In addition, the polymerized toner is easy to aggregate or fuse, so that there is a limit to the demonomer treatment by the heat treatment or the like. In recent years, there has been a strong demand for development of a polymerized toner capable of being fixed at a low temperature for the purpose of achieving speeding-up of printing and formation of full-color images. However, it is extremely difficult in such a low-temperature fixing toner to reduce the content of the remaining monomer while preventing aggregation or fusion.

The polymerized toner contains various volatile organic compounds secondarily produced in the polymerization reaction in addition to the remaining monomer. The volatile organic compounds are vaporized out of the toner by heating upon fixing, or the like, so that the volatile organic compounds have an important adverse influence on the toner properties like the remaining monomer. In particular, when a polymerization initiator high in initiation efficiency is used, volatile organic compounds such as ether compounds are easy to be formed by side reactions, and such compounds come to be contained in the resulting polymerized toner. The unreacted polymerizable monomer and the other volatile organic compounds will hereinafter be referred to as volatile organic components (VOC) collectively.

As a method for reducing the content of the remaining monomer or volatile organic compounds in the polymerized toner, it has heretofore been known to polymerize a polymerizable monomer composition comprising a polymerizable monomer and a colorant in an aqueous dispersion medium and then subjecting a dispersion containing polymer particles formed to a stripping treatment.

As a stripping treatment method using saturated steam, for example, Japanese Patent Application Laid-Open No. 5-100485 (Patent Literature 1) discloses a stripping treatment method, in which after a polymerizable monomer composition comprising a polymerizable monomer and a colorant is suspension-polymerized, a suspension (dispersion) containing toner particles (polymer particles) is heated, and water is then distilled out of the suspension while introducing saturated steam of 100° C. into the suspension. According to the stripping treatment method of Patent Literature 1, the content of the remaining monomer can be reduced to 90 ppm (Example 1).

Japanese Patent Application Laid-Open No. 2004-4383 (Patent Literature 2) discloses a stripping treatment method, in which after a polymerizable monomer composition comprising a polymerizable monomer and a colorant is suspension-polymerized, saturated steam higher than 100° C. is introduced into an aqueous medium (dispersion) containing toner particles. The stripping treatment method of Patent Literature 2 has a feature in that saturated steam of a high temperature exceeding 100° C. is continuously blown into the dispersion containing polymer particles to increase the amount of the aqueous medium while retaining the temperature of the aqueous medium at the boiling point (100° C.).

Japanese Patent Application Laid-Open No. 2006-208624 (Patent Literature 3) discloses a stripping treatment method, in which a carrier gas is introduced into a polymer dispersion containing toner particles to remove organic volatile components (volatile organic components). In Patent Literature 3, saturated steam is shown as the carrier gas.

However, the stripping treatment method using saturated steam of a high temperature by itself takes a long time to reduce the content of the remaining monomer or volatile organic components, and the degree of reduction is not always sufficient, so that this method is not efficient. In addition, when the high temperature saturated steam is blown into the dispersion containing the polymer particles, the polymer particles are easy to cause partial aggregation or fusion. In particular, when the method of continuously blowing the saturated steam of the high temperature exceeding 100° C. is adopted, the temperature of the dispersion is raised even to 100° C. during the stripping, so that the polymer particles designed to be a low-temperature fixing type are easy to fuse or change the surface properties thereof. Further, according to the method of blowing the saturated steam of the high temperature, the liquid level of the dispersion is greatly raised during the long-time stripping treatment, or it is difficult to control the level of a bubble layer on the liquid level. When water is distilled off during the stripping treatment for inhibiting the rise of the liquid level, the quantity of heat for distillation is required, and the process thereof becomes complicated.

On the other hand, as a stripping treatment method using an inert gas, Patent Literature 3 also discloses a method using, as the carrier gas, the inert gas in addition to the saturated steam.

Japanese Patent Application Laid-Open No. 2004-271816 (Patent Literature 4) discloses a method, in which in a step of subjecting a dispersion containing polymer particles to a stripping treatment to remove the remaining monomer in the polymer particles, a gas such as an inert gas is blown while controlling a bubble level on the liquid level of the dispersion.

Japanese Patent Application Laid-Open No. 2007-65426 (Patent Literature 5) discloses a stripping treatment method, in which a gas composed of air or an inert gas is blown into a dispersion containing colored polymer particles (polymerized toner) in an evaporator, and at this time a flow rate of the gas and the pressure of a vapor phase in the evaporator are controlled within respective specified ranges.

According to the stripping treatment method of blowing the gas such as the inert gas into the dispersion containing the polymer particles, the content of the remaining monomer can be reduced while preventing the aggregation or fusion of the polymer particles. In addition, the flow rate of the inert gas is controlled, whereby the level of a bubble layer generated on the liquid level of the dispersion can be controlled.

However, the conventional stripping treatment method using the saturated steam or inert gas by itself is not sufficient to efficiently and sufficiently reduce the content (TVOC content) of total volatile organic components including the remaining monomer.

According to the results of investigation by the present inventor, it has been proved that the stripping treatment method of blowing the inert gas such as nitrogen gas into the dispersion containing the polymer particles is insufficient in the efficiency to remove the volatile organic compounds, and it is thus difficult to reduce the TVOC content in the resulting polymerized toner to a sufficient and low level. In addition, this polymerized toner is not sufficient in printing durability. In particular, when a printing durability test is carried out on this polymerized toner under a high-temperature and high-humidity environment, it is difficult to sufficiently increase the number of paper sheets, on which printing can be continuously conducted up to occurrence of fog. It has more importantly been proved that vertical stripes are easy to occur on printing paper in a stage that the number of paper sheets continuously printed is relatively small even when the printing durability test is carried out on this polymerized toner under a normal-temperature and normal-humidity environment.

The stripping treatment method using the saturated steam involves such problems as described above, the TVOC content in the polymerized toner obtained thereby is at a high level, and the printing durability test on this polymerized toner results in the fact that the number of paper sheets continuously printed is smaller compared with the polymerized toner obtained by conducting the stripping treatment with the inert gas.

In recent years, there has been a tendency for environmental regulations to be tightened, and so the image forming apparatus of the electrophotographic system have also been strongly required to more reduce the volatile organic components volatilized upon fixing of a toner under heat, or the like.

Patent Literature 1: Japanese Patent Application Laid-Open No. 5-100485 (corresponding to U.S. Pat. No. 5,476,745)

Patent Literature 2: Japanese Patent Application Laid-Open No. 2004-4383 (corresponding to US 2003/0224276 A1)

Patent Literature 3: Japanese Patent Application Laid-Open No. 2006-208624

Patent Literature 4: Japanese Patent Application Laid-Open No. 2004-271816

Patent Literature 5: Japanese Patent Application Laid-Open No. 2007-65426 (corresponding to US 2007/0048645 A1)

DISCLOSURE OF THE INVENTION

Technical Problem

It is an object of the present invention to provide a polymerized toner, in which the content of volatile organic components including an unreacted polymerizable monomer is markedly reduced, and which is excellent in toner properties.

More specifically, the object of the present invention is to provide a production process of a polymerized toner, by which a polymerized toner markedly reduced in the content of total volatile organic components can be efficiently and stably obtained by a stripping treatment of a dispersion after polymerization.

From the viewpoint of toner properties, the object of the present invention is to provide a polymerized toner which is inhibited from emitting offensive odor and hard to cause phenomena such as blocking, offset and toner filming, and moreover is excellent in printing durability under a normal-temperature and normal-humidity environment and a high-temperature and high-humidity environment and hard to cause vertical stripes on printing paper.

From the viewpoint of efficient and stable operation of the stripping treatment, the object of the present invention is to provide a production process of a polymerized toner, by which relatively gentle treatment conditions can be adopted, the level of a bubble layer on the liquid level of a dispersion to be treated can be easily controlled, the content of total volatile organic components can be markedly reduced in a relatively short period of time, and a stripping treatment method capable of smoothly operating an apparatus is adopted.

The present inventor has carried out an extensive investigation with a view toward achieving the above object. As a result, the inventors has reached a method of performing a stripping treatment after polymerization using both inert gas and saturated steam in a production process of a polymerized toner comprising a step of polymerizing a polymerizable monomer composition containing a colorant and a polymerizable monomer in the presence of a polymerization initiator in an aqueous dispersion medium.

In the production process according to the present invention, the striping treatment is conducted by a method, in which a dispersion containing polymer particles is introduced into an evaporator, and a gas is blown into the dispersion within the evaporator to discharge volatile organic components including an unreacted polymerizable monomer out of the evaporator concomitantly with the gas. At that time, both inert gas and saturated steam are used as the gas blown into the dispersion.

It has been found that the stripping treatment is conducted by using both inert gas and saturated steam, whereby the content (TVOC content) of total volatile organic components contained in the polymerized toner can be markedly reduced compared with the case of single use thereof. The polymerized toner obtained according to this method is markedly improved in printing durability under a normal-temperature and normal-humidity environment and a high-temperature and high-humidity environment and inhibited in occurrence of vertical stripes on printing paper.

In addition, the inert gas and saturated steam are used in combination as the gas blown into the dispersion, whereby the various problems involved in the case of the single use of the saturated steam can be relieved or overcome. When saturated steam of a high temperature is blown into the dispersion over a long period of time, aggregation or fusion of the polymer particles is easy to occur, and difficulty is encountered on control of the temperature and amount of the dispersion. Among the conventional methods, the method of continuously blowing the saturated steam of the high temperature into the dispersion to keep the temperature of the dispersion at 100° C. easily causes fusion of polymer particles or change of surface properties thereof. According to the method of blowing the saturated steam, it is impossible to quickly control the amount and temperature of the dispersion when the level of a bubble layer generated on the liquid level of the dispersion rises or falls, so that it is difficult to control the level of the bubble layer. According to the method of the present invention, the amount of the saturated steam blown can be reduced, thereby relieving or overcoming these various problems.

The inert gas and saturated steam are used in combination, whereby the stripping treatment can be stably performed without causing the problem of aggregation or fusion of the polymerized toner by reducing the amount of the saturated steam blown even when the polymerized toner is designed to be a low-temperature fixing type. Quite naturally, the method of the present invention can also be applied to the production of another polymerized toner than that of the low-temperature fixing type.

The inert gas and saturated steam are used in combination as the gas blown into the dispersion, and at that time, the flow rate of the inert gas between the inert gas and the saturated steam is mainly changed, thereby permitting rapidly coping with variations in the level of the bubble layer generated on the liquid level of the dispersion. In addition, the level of the bubble layer is raised to an allowable height, whereby the removal efficiency of the volatile organic components can be increased. When the level of the bubble layer becomes too high or too low, the flow rate of the inert gas is mainly controlled, whereby the level of the bubble layer can be retained to a desired level. Contamination of an apparatus and clogging of piping by adhesion of bubbles can be thereby prevented to relieve the necessity of cleaning.

The inert gas and saturated steam may be blown into the dispersion as individual flows. Alternatively, both flows may be put together to blow them as one flow into the dispersion. When the method of putting the flows of the inert gas and saturated steam together to blow them from one blowing tube is adopted, the aggregation or fusion of the polymer particles and the change of surface properties thereof can be relieved compared with the case where the saturated steam is blown into the dispersion as a separate flow. When the inert gas is continuously blown, a strainer arranged in the blowing tube is easy to cause clogging. However, when the method of putting the flows of the inert gas and saturated steam together to blow them from one blowing tube is adopted, the clogging of the strainer can be inhibited. According to this method, an already existing evaporator, in which one blowing tube has been arranged, can be used.

The present invention has been led to completion on the basis of these findings.

Solution to Problem

According to the present invention, there is provided a process for producing a polymerized toner, comprising Production Step 1 of polymer particles, including a step of polymerizing a polymerizable monomer composition containing a colorant and a polymerizable monomer in the presence of a polymerization initiator in an aqueous dispersion medium; Stripping Treatment Step 2 of subjecting a dispersion containing the polymer particles to a stripping treatment to remove volatile organic components including an unreacted polymerizable monomer; and Collecting Step 3 of collecting the polymer particles from the dispersion after the stripping treatment, wherein in Stripping Treatment 2, (1) the dispersion containing the polymer particles is introduced into an evaporator, (2) the stripping treatment is conducted by a method, in which a gas is blown into the dispersion within the evaporator to discharge the volatile organic components including the unreacted polymerizable monomer out of the evaporator concomitantly with the gas, and (3) both inert gas and saturated steam are used as the gas blown into the dispersion.

Advantageous Effects of Invention

According to the production process of the present invention, the content (TVOC content) of the volatile organic components including the unreacted polymerizable monomer can be markedly reduced to provide a polymerized toner excellent in toner properties. According to the production process of the present invention, a polymerized toner markedly reduced in the content of the total volatile organic components by the stripping treatment of the dispersion after the polymerization can be efficiently and stably obtained.

According to the production process of the present invention, there can be provided a polymerized toner which is inhibited from emitting offensive odor, hard to cause phenomena such as blocking, offset and toner filming, excellent in printing durability under a normal-temperature and normal-humidity environment and a high-temperature and high-humidity environment and hard to cause vertical stripes on printing paper.

According to the present invention, there can be provided a production process of a polymerized toner, by which relatively gentle treatment conditions can be adopted, the level of a bubble layer on the liquid level of a dispersion to be treated can be easily controlled, the content of total volatile organic components can be markedly reduced in a relatively short period of time, and a stripping treatment method capable of smoothly operating an apparatus is adopted.

BRIEF DESCRIPTION OF THE DRAWINGS

FIG. 1 illustrates a system of a stripping treatment step adopted in Examples of the present invention.

Meanings of characters in FIG. 1 are as follows:

1: Evaporator
2: Agitating blade
3: Non-contact type bubble level meter
4: Pressure gauge
5: Thermometer
6: Gas line
7: Condenser
8: Condensing tank
9: Gas line
10: Volatile substance-removing device
11: Gas line
12: Blower
13: Inlet line of inert gas and saturated steam
14: Blowing tube
15: Valve
16: Nitrogen gas source
17: Steam (saturated steam) source

BEST MODE FOR CARRYING OUT THE INVENTION

1. Production Step 1 of Polymer Particles

The production process of a polymerized toner according to the present invention comprises Production Step 1 of polymer particles, including a step of polymerizing a polymerizable monomer composition containing a colorant and a polymerizable monomer in the presence of a polymerization initiator in an aqueous dispersion medium. The polymerizable monomer composition is polymerized to form colored polymer particles. If desired, a step of polymerizing a polymerizable monomer for shell in the presence of the colored polymer particles may be added to form core-shell type polymer particles.

As the aqueous dispersion medium, water such as ion-exchanged water is generally used. However, a dispersion medium with a hydrophilic solvent such as alcohol added to water may also be used if desired. The polymerizable monomer composition may contain various kinds of additives such as a charge control agent, a parting agent, a crosslinkable monomer, a macromonomer, a molecular weight modifier, a lubricant and a dispersion aid as needed.

(1) Polymerizable Monomer:

In the present invention, a monovinyl monomer is used as a main component of the polymerizable monomer. Examples of the monovinyl monomer include aromatic vinyl monomers such as styrene, vinyltoluene and α-methylstyrene; (meth) acrylic acid; (meth)acrylic acid derivatives such as methyl (meth)acrylate, ethyl(meth)acrylate, propyl(meth)acrylate, butyl(meth)acrylate, 2-ethylhexyl(meth)acrylate, cyclohexyl (meth)acrylate, isobornyl(meth)acrylate, dimethylaminoethyl(meth)acrylate and (meth)acrylamide; and monoolefin monomers such as ethylene, propylene and butylene. Here, (meth)acrylic acid means both acrylic acid and methacrylic acid. The other (meth)acrylic acid derivatives should also be understood likewise.

The monovinyl monomers may be used either singly or in any combination thereof. Of these monovinyl monomers, a single aromatic vinyl monomer, or a combination of the aromatic vinyl monomer and a (meth)acrylic acid derivative is preferably used.

When a crosslinkable monomer or crosslinkable polymer is used together with the monovinyl monomer, the hot offset property of the resulting toner can be improved. The crosslinkable monomer means a monomer having at least two vinyl groups. As specific examples thereof, may be mentioned aromatic divinyl compounds such as divinylbenzene, divinylnaphthalene and derivatives thereof; diethylenically unsaturated carboxylic acid esters such as ethylene glycol dimethacrylate, diethylene glycol dimethacrylate and 1,4-butanediol diacrylate; compounds having two vinyl groups, such as N,N-divinylaniline and divinyl ether; and compounds having three or more vinyl groups, such as pentaerythritol triallyl ether and trimethylolpropane triacrylate.

The crosslinkable polymer is a polymer having two or more vinyl groups in the polymer. As specific examples thereof, may be mentioned esterified products obtained by a condensation reaction of a polymer having two or more hydroxyl groups such as polyethylene, polypropylene, polyester or polyethylene glycol and an unsaturated carboxylic acid monomer such as acrylic acid or methacrylic acid.

These crosslinkable monomers and crosslinkable polymers may be used either singly or in any combination thereof. The amount of the crosslinkable monomer or polymer used is generally at most 10 parts by weight, preferably 0.01 to 7 parts by weight, more preferably 0.05 to 5 parts by weight, particularly preferably 0.1 to 3 parts by weight per 100 parts by weight of the monovinyl monomer.

It is preferable to use a macromonomer together with the monovinyl monomer because the high-temperature storage stability and the low-temperature fixing ability of the resulting polymerized toner can be reconciled. The macromonomer is a macromolecule having a polymerizable carbon-carbon unsaturated double bond at its molecular chain terminal and is an oligomer or polymer having a number average molecular weight of generally 1,000 to 30,000. When the number average molecular weight falls within the above range, the fixing ability and storage stability of the resulting polymerized toner can be retained without impairing the melt properties of the macromonomer. Thus, the macromonomer preferably has a number average molecular weight within the above range.

As examples of the polymerizable carbon-carbon unsaturated double bond that the macromonomer has at its molecular chain terminal, may be mentioned an acryloyl group and a methacryloyl group. However, the methacryloyl group is preferred from the viewpoint of easy copolymerization. The macromonomer is preferably that capable of providing a polymer having a glass transition temperature higher than that of a polymer obtained by polymerizing the monovinyl monomer.

As specific examples of the macromonomer, may be mentioned polymers obtained by polymerizing styrene, styrene derivatives, methacrylic esters, acrylic esters, acrylonitrile and methacrylonitrile either singly or in combination of two or more monomers thereof; and macromonomers having a polysiloxane skeleton. Among these, hydrophilic macromonomers are preferred, with macromonomers composed of a polymer obtained by polymerizing a methacrylic ester or acrylic ester by itself or in combination thereof being particularly preferred.

When the macromonomer is used, the used amount thereof is generally 0.01 to 10 parts by weight, preferably 0.03 to 5 parts by weight, more preferably 0.05 to 1 part by weight per 100 parts by weight of the monovinyl monomer. When the amount the macromonomer used falls within the above range, the fixing ability of the resulting polymerized toner is improved while retaining its storage stability. Thus, the macromonomer is preferably used in the amount within the above range.

(2) Colorant:

As the colorant, may be used any of various kinds of pigments and dyes used in the field of toners, such as carbon black and titanium white. As examples of black colorants, may be mentioned carbon black and nigrosine-based dyes and pigments; and magnetic particles such as cobalt, nickel, triiron tetroxide, manganese iron oxide, zinc iron oxide and nickel iron oxide. When carbon black is used, that having a primary particle diameter of 20 to 40 nm is preferably used in that the resulting toner can provide images good in image quality, and the safety of the toner in environment is also enhanced. As colorants for color toners, may be used yellow colorants, magenta colorants, cyan colorants, etc.

As the yellow colorants, may be used fused azo compounds, isoindolinone compounds, anthraquinone compounds, azo metallic complexes, methine compounds, allylamide compounds or the like. Specific examples thereof include C.I. Pigment Yellow 3, 12, 13, 14, 15, 17, 62, 65, 73, 74, 83, 90, 93, 95, 96, 97, 109, 110, 111, 120, 128, 129, 138, 147, 155, 168, 180 and 181. Besides the above, Naphthol Yellow S, Hansa Yellow G and C.I. Vat Yellow are mentioned as yellow colorants.

Examples of the magenta colorants include fused azo compounds, diketopyrrolopyrrole compounds, anthraquinone compounds, quinacridone compounds, basic dye lake compounds, naphthol compounds, benzimidazolone compounds, thioindigo compounds and perillene compounds. Specific examples thereof include C.I. Pigment Red 2, 3, 5, 6, 7, 23, 48, 48:2, 48:3, 48:4, 57, 57:1, 58, 60, 63, 64, 68, 81, 81:1, 83, 87, 88, 89, 90, 112, 114, 122, 123, 144, 146, 149, 163, 166, 169, 170, 177, 184, 185, 187, 202, 206, 207, 209, 220, 251 and 254. Besides the above, for example, C.I. Pigment Violet 19 is mentioned as a magenta colorant.

Examples of the cyan colorants include copper phthalocyanine compounds and derivatives thereof, anthraquinone compounds, and basic dye lake compounds. Specific examples thereof include C.I. Pigment Blue 1, 2, 3, 6, 7, 15, 15:1, 15:2, 15:3, 15:4, 16, 17, 60, 62 and 66. Besides the above, for example, Phthalocyanine Blue, C.I. Vat Blue and C.I. Acid Blue are mentioned as cyan colorants.

These colorants may be used either singly or in combination of two or more colorants thereof. The colorant is used in a proportion of generally 0.1 to 50 parts by weight, preferably 1 to 20 parts by weight per 100 parts by weight of the polymerizable monomer.

(3) Charge Control Agent:

In order to improve the charge properties of the resulting polymerized toner, various kinds of charge control agents having positively charging ability or negatively charging ability are preferably contained in the polymerizable monomer composition. Examples of the charge control agents include metal complexes of organic compounds having a carboxyl group or a nitrogen-containing group, metallized dyes, nigrosine and charge control resins.

As specific examples of charge control agents including commercially available products, may be mentioned charge control agents such as BONTRON N-01 (product of Orient Chemical Industries Ltd., trademark), NIGROSINE BASE EX (product of Orient Chemical Industries Ltd., trademark), SPILON BLACK TRH (product of Hodogaya Chemical Co., Ltd., trademark), T-77 (product of Hodogaya Chemical Co., Ltd., trademark), BONTRON S-34 (product of Orient Chemical Industries Ltd., trademark), BONTRON E-81 (product of Orient Chemical Industries Ltd., trademark), BONTRON E-84 (product of Orient Chemical Industries Ltd., trademark), BONTRON E-89 (product of Orient Chemical Industries Ltd., trademark), BONTRON F-21 (product of Orient Chemical Industries Ltd., trademark), COPY CHARGE NX VP434 (product of Clariant Co., trademark), COPY CHARGE NEG VP2036 (product of Clariant Co., trademark), TNS-4-1 (product of Hodogaya Chemical Co., Ltd.), TNS-4-2 (product of Hodogaya Chemical Co., Ltd.), LR-147 (product of The Japan Carlit Co., Ltd.) and COPY BLUE PR (product of Clamant Co., trademark); and charge control resins such as quaternary ammonium (salt) group-containing copolymers and sulfonic (salt) group-containing copolymers. The charge control agent is used in a proportion of generally 0.01 to 10 parts by weight, preferably 0.1 to 10 parts by weight per 100 parts by weight of the polymerizable monomer.

(4) Parting Agent:

In order to, for example, prevent offset and improve the parting ability of the resulting polymerized toner upon fixing by a heated roll, a parting agent may be contained in the polymerizable monomer composition. Examples of the parting agent include polyolefin waxes such as low-molecular weight polyethylene, low-molecular weight polypropylene and low-molecular weight polybutylene; vegetable natural waxes such as candelilla wax, carnauba wax, rice wax, Japan wax and jojoba wax; petroleum waxes such as paraffin wax, microcrystalline wax and petrolatum, and modified waxes thereof; synthetic waxes such as Fischer-Tropsch wax; and esterified products (polyfunctional ester compounds) of polyhydric alcohols, such as pentaerythritol esters such as pentaerythritol tetramyristate, pentaerythritol tetrapalmitate, pentaerythritol tetrastearate and pentaerythritol tetralaurate, and dipentaerythritol esters such as dipentaerythritol hexamyristate, dipentaerythritol hexapalmitate and dipentaerythritol hexylaurate. These parting agents may be used either singly or in combination of two or more compounds thereof.

Among these parting agents, Fischer-Tropsch wax and polyfunctional ester compounds, whose endothermic peak temperatures fall within a range of 30 to 150° C., preferably 50 to 120° C., more preferably 60 to 110° C. as determined from a DSC curve upon heating thereof by means of a differential scanning calorimeter, are particularly preferred from the viewpoint of a balance between the fixing ability and the parting ability of the resulting toner. The proportion of the parting agent used is generally 0.1 to 50 parts by weight, preferably 0.5 to 20 parts by weight, more preferably 1 to 10 parts by weight per 100 parts by weight of the polymerizable monomer.

(5) Polymerization Initiator:

As examples of the polymerization initiator for the polymerizable monomer, may be mentioned persulfates such as potassium persulfate and ammonium persulfate; azo compounds such as 4,4'-azobis(4-cyanovaleric acid), 2,2'-azobis [2-methyl-N-(2-hydroxyethyl)propionamide], 2,2'-azobis(2-amidino-propane) dihydrochloride, 2,2'-azobis(2,4-dimethylvaleronitrile) and 2,2'-azobis-isobutyronitrile; and peroxides such as di-t-butyl peroxide, dicumyl peroxide, lauroyl peroxide, benzoyl peroxide, t-butyl peroxy-2-ethylhexanoate, t-hexyl peroxy-2-ethylhexanoate, t-butyl peroxypivalate, di-isopropyl peroxydicarbonate, di-t-butyl peroxyisophthalate, 1,1',3,3'-tetramethylbutyl peroxy-2-ethylhexanoate and t-butyl peroxyisobutyrate. Redox initiators obtained by combining these polymerization initiators with a reducing agent may also be used.

Among these polymerization initiators, an oil-soluble polymerization initiator, which is soluble in the polymerizable monomer, is preferably selected, and a water-soluble polymerization initiator may also be used in combination with the oil-soluble initiator as needed.

As the polymerization initiator used in the present invention, is preferred an organic peroxide having a molecular weight of 90 to 205 and a purity of at least 90%. The molecular weight of the polymerization initiator is more preferably 170 to 200, still more preferably 175 to 195. The purity of the polymerization initiator is indicated as % by weight of a polymerization initiator as a main component and is preferably at least 92%, more preferably at least 95%.

The one-hour half-life temperature of the organic peroxide is preferably 70 to 95° C., more preferably 75 to 95° C., still more preferably 85 to 95° C. because a toner good in printing durability is obtained. The half-life temperature is an index indicating easiness of occurrence of cleavage of the polymerization initiator and indicates a temperature at which the polymerization initiator is decomposed when the polymerization initiator is held at a fixed temperature, thereby reducing the amount of the polymerization initiator to a half of the original amount after a fixed period of time. For example, the one-hour half-life temperature is a half-life temperature when this fixed period of time is 1 hour.

The above-described specific polymerization initiator is used, whereby the amounts of an unreacted polymerizable monomer remaining in the resulting polymer particles and by-products such as an ether component secondarily produced by the polymerization initiator can be lessened. As a result, a toner, which is excellent in high-temperature storage stability, neither emits offensive odor upon printing nor worsen an ambient environment, and is excellent in printing durability, can be obtained.

As the organic peroxide of the polymerization initiator, a peroxyester is preferred because it is high in initiation efficiency and can reduce the content of the remaining monomer, and a non-aromatic peroxyester (i.e., peroxyester having no aromatic ring) is more preferred.

The organic peroxide used as the polymerization initiator is preferably a non-aromatic peroxyester represented by the following formula (1):

[Chem. 1]

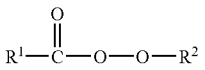

(1)

(in the formula, $R^1$ is an alkyl group having at most 8 carbon atoms, and $R^2$ is an alkyl group having at most 8 carbon atoms).

$R^1$ in the formula (1) is an alkyl group having at most 8 carbon atoms, and preferable specific examples thereof include secondary alkyl groups such as isopropyl, 1-methylpropyl, 1-ethylpropyl, 1-methylbutyl, 2-methylbutyl, 3-methyl-butyl, 1-ethylpropyl, 2-methylhexyl and 2-ethylhexyl. $R^2$ in the formula (1) is an alkyl group having at most 8 carbon atoms, and is preferably t-butyl or t-hexyl, more preferably t-butyl.

Specific examples of the non-aromatic peroxyester represented by the formula (1) include t-butyl peroxy-2-methylhexanoate, t-butyl peroxy-2-ethyl-hexanoate, t-butyl peroxy-2-ethylbutanoate and t-hexyl peroxypivalate (i.e., t-hexyl peroxy-2,2-dimethylacetate).

The polymerization initiator is used in a proportion of generally 0.1 to 20 parts by weight, preferably 0.3 to 15 parts by weight, more preferably 0.5 to 10 parts by weight per 100 parts by weight of the polymerizable monomer.

The polymerization initiator may be added into the polymerizable monomer composition in advance. In order to avoid premature polymerization, however, the polymerization initiator is preferably added directly into a suspension after completion of the step of forming droplets of the polymerizable monomer composition or in the middle of a polymerization reaction.

(6) Molecular Weight Modifier:

A molecular weight modifier is preferably used upon the polymerization. As examples of the molecular weight modifier, may be mentioned mercaptans such as t-dodecylmercaptan, n-dodecylmercaptan, n-octylmercaptan, tetraethylthiuram disulfide and 2,2,4,6,6-pentamethylheptane-4-thiol; and halogenated hydrocarbons such as carbon tetrachloride and carbon tetrabromide. The molecular weight modifier is generally contained in the polymerizable monomer composition prior to the initiation of the polymerization. However, it may also be added in the middle of the polymerization. The molecular weight modifier is used in a proportion of generally 0.01 to 10 parts by weight, preferably 0.1 to 5 parts by weight per 100 parts by weight of the polymerizable monomer. If the amount of the molecular weight modifier is too small, the effect of molecular weight modification is not achieved. If the amount is too great, the amounts of the remaining monomer and remaining VOC are increased.

(7) Dispersion Stabilizer:

In the present invention, an aqueous dispersion medium, to which a dispersion stabilizer has been added, is generally used. As the dispersion stabilizer, is preferred colloid of a hardly water-soluble metallic compound. As examples of the hardly water-soluble metallic compound, may be mentioned sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and ferric hydroxide. Among these, colloids of hardly water-soluble metal hydroxides are preferred because the particle diameter distribution of polymer particles to be formed can be narrowed to improve the brightness of an image to be formed.

The colloid of the hardly water-soluble metallic compound is not limited by the production process thereof. However, colloid of a hardly water-soluble metal hydroxide obtained by adjusting the pH of an aqueous solution of a water-soluble polyvalent metallic compound to 7 or higher is preferably used, and colloid of a hardly water-soluble metal hydroxide formed by reacting a water-soluble polyvalent metallic compound with an alkali metal hydroxide salt in an aqueous phase is particularly preferably used. The colloid of the hardly water-soluble metallic compound preferably has number particle diameter distributions, $D_{50}$ (50% cumulative value of number particle diameter distribution) of at most 0.5 μm and $D_{90}$ (90% cumulative value of number particle diameter distribution) of at most 1 μm.

The dispersion stabilizer is used in a proportion of generally 0.1 to 20 parts by weight per 100 parts by weight of the polymerizable monomer. If this proportion is too low, it is difficult to achieve sufficient polymerization stability, so that polymer aggregates are liable to be formed. If this proportion is too high to the contrary, the viscosity of an aqueous solution becomes too high, and the polymerization stability is lowered.

In the present invention, a water-soluble polymer may be used as a dispersion stabilizer as needed. As examples of the water-soluble polymer, may be mentioned polyvinyl alcohol, methyl cellulose and gelatin. In the present invention, there is no need to use a surfactant. However, the surfactant may be used within limits not increasing the dependency of charging property of the resulting polymerized toner on environment for stably conducting the suspension polymerization.

(8) Polymerization Step:

A polymerized toner is composed of colored polymer particles in which a polymer formed by polymerization of a polymerizable monomer becomes a binder resin, and additive components such as a colorant, a charge control agent and a parting agent are dispersed therein. The colored polymer particles may be used as core particles, and a shell formed of a polymer layer may be formed on the core particles to provide core-shell type polymer particles.

The polymerized toner can be obtained in accordance with, for example, the following process. A polymerizable monomer, a colorant and other additives are mixed by means of a mixer, and the resultant mixture is subjected to wet grinding by means of a media type wet grinding machine (for example, a bead mill), as needed, to prepare a polymerizable monomer composition. The polymerizable monomer composition is then dispersed and agitated in an aqueous dispersion medium containing a dispersion stabilizer to form uniform droplets (primary droplets having a volume average droplet diameter of about 50 to 1,000 μm) of the polymerizable monomer composition. In order to avoid premature polymerization, it is preferable to add a polymerization initiator to the aqueous dispersion medium after the size of the droplets in the aqueous dispersion medium becomes uniform.

The polymerization initiator is added and mixed with a suspension in which the droplets of the polymerizable monomer composition have been dispersed in the aqueous dispersion medium, and the resultant mixture is further agitated by means of a high-speed rotation shearing type agitator until the droplet diameter of the droplets becomes a fine droplet diameter near to that of the intended polymerized toner particles. The suspension containing the thus-formed droplets (secondary droplets having a volume average droplet diameter of about 1 to 12 μm) having a fine droplet diameter is charged into a polymerization reactor to conduct suspension polymerization at a temperature of generally 5 to 120° C., preferably 35 to 95° C. Since a polymerization initiator high in catalytic activity must be used if the polymerization temperature is too low, it is difficult to control the polymerization reaction. If the polymerization temperature is too high, and an additive melted at a low temperature is contained, this additive may bleed on the surface of the resulting polymerized toner to deteriorate the storage stability of the polymerized toner.

The volume average droplet diameter and droplet diameter distribution of the fine droplets of the polymerizable monomer composition affect the volume average particle diameter and particle diameter distribution of the resulting polymerized toner. If the droplet diameter of the droplets is too great, the particle diameter of the polymerized toner particles to be formed becomes too great to lower the resolution of an image to be formed. If the droplet diameter distribution of the droplets is too wide, the fixing temperature of the resulting polymerized toner varies to cause inconveniences such as occurrence of fogging or toner filming. Accordingly, the droplets of the polymerizable monomer composition are desirably formed so as to have almost the same size as that of the polymerized toner particles to be formed.

The volume average droplet diameter of the droplets of the polymerizable monomer composition is generally 1 to 12 μm, preferably 2 to 10 μm, more preferably 3 to 9 μm. When it is intended to provide a polymerized toner having a particularly small particle diameter for providing a high-definition image, it is desirable to make the volume average droplet diameter of the droplets small. The droplet diameter distribution (volume average droplet diameter/number average droplet diameter) of the droplets of the polymerizable monomer composition is generally 1 to 3, preferably 1 to 2.5, more preferably 1 to 2. When particularly fine droplets are formed, it is preferable to adopt a method, in which an aqueous dispersion medium containing the polymerizable monomer composition is passed through between a rotor rotated on its axis at a high speed and a stator surrounding it and having small openings or comb-like teeth.

As the polymerizable monomer, at least one is selected from among the above-mentioned monovinyl monomers. In order to lower a fixing temperature of the resulting toner, a polymerizable monomer or a combination of polymerizable monomers, which permits forming a polymer having a glass transition temperature (Tg) of the order of generally 80° C. or lower, preferably 40 to 80° C., more preferably 50 to 70° C., is preferably selected. When the polymer forming the binder resin is a copolymer in the present invention, the Tg thereof is a calculated value (referred to as "calculated Tg") calculated out according to the kinds and proportions of the polymerizable monomers used.

The suspension polymerization forms colored polymer particles with the additive components such as the colorant dispersed in the polymer of the polymerizable monomer. In the present invention, the colored polymer particles may be used as a polymerized toner. In order to improve the storage stability (blocking resistance), low-temperature fixing ability and melting ability upon fixing of the resulting polymerized toner, however, an additional polymer layer may be formed on the colored polymer particles obtained by the suspension polymerization to provide a capsule toner having a core-shell type structure.

As a process for forming the core-shell type structure, may be adopted a process in which the colored polymer particles are used as core particles, and a polymerizable monomer for shell is additionally polymerized in the presence of the core particles to form a polymer layer (shell) on each surface of the core particles. When a monomer forming a polymer having a Tg higher than the Tg of the polymer component forming the core particles is used as the polymerizable monomer for shell, the storage stability of the resulting polymerized toner can be improved. On the other hand, the Tg of the polymer component forming the core particles is preset low, thereby permitting lowering the fixing temperature of the resulting polymerized toner and improving the melting properties. Accordingly, the core-shell type polymer particles are formed in the polymerization step, thereby providing a polymerized toner capable of coping with speeding-up of printing (copying, printing, etc.), formation of full-color images and permeability through OHP (overhead projector).

As polymerizable monomers for forming the core and shell, respective preferable monomers may be suitably selected from among the above-mentioned monovinyl monomers. A weight ratio of the polymerizable monomer for core to the polymerizable monomer for shell is generally 40/60 to 99.9/0.1, preferably 60/40 to 99.7/0.3, more preferably 80/20 to 99.5/0.5. If the proportion of the polymerizable monomer for shell is too low, the effect of improving the storage stability of the resulting polymerized toner becomes little. If the proportion is too high, the effect of lowering the fixing temperature of the resulting polymerized toner becomes little.

The Tg of the polymer formed from the polymerizable monomer for shell is generally higher than 50° C., but not higher than 120° C., preferably higher than 60° C., but not higher than 110° C., more preferably higher than 80° C., but not higher than 105° C. A difference in Tg between the polymer formed from the polymerizable monomer for core and the polymer formed from the polymerizable monomer for shell is preferably at least 10° C., more preferably at least 20° C., particularly preferably at least 30° C. In many cases, a monomer capable of forming a polymer having a Tg of generally at most 60° C., preferably 40 to 60° C. is preferably selected as the polymerizable monomer for core from the viewpoint of a balance between fixing temperature and storage stability. On the other hand, as the polymerizable monomer for shell, monomers capable of forming a polymer having a Tg higher than 80° C., such as styrene and methyl methacrylate, may be preferably used either singly or in combination of two or more monomers thereof.

The polymerizable monomer for shell is preferably added to the polymerization reaction system as droplets having a droplet diameter smaller than the average particle diameter of the core particles. If the droplet diameter of the droplets of the polymerizable monomer for shell is too great, it is difficult to uniformly form a polymer layer around the core particles. In order to form the polymerizable monomer for shell into fine droplets, it is only necessary to subject a mixture of the polymerizable monomer for shell and an aqueous dispersion medium to a finely dispersing treatment by means of, for example, an ultrasonic emulsifier and add the resultant dispersion to the polymerization reaction system.

When the polymerizable monomer for shell is a relatively water-soluble monomer (for example, methyl methacrylate) having a solubility of at least 0.1% by weight in water at 20° C., the monomer tends to relatively quickly migrate into the surfaces of the core particles, so that there is no need to conduct the finely dispersing treatment. However, it is preferable to conduct the finely dispersing treatment from the viewpoint of forming a uniform shell. When the polymerizable monomer for shell is a monomer (for example, styrene) having a solubility lower than 0.1% by weight in water at 20° C., it is preferable that the monomer be made easy to migrate into the surfaces of the core particles by conducting the finely dispersing treatment or adding an organic solvent (for example, an alcohol) having a solubility of at least 5% by weight in water at 20° C. to the reaction system.

A charge control agent may be added to the polymerizable monomer for shell. As the charge control agent, is preferred the same charge control agent as that used in the production of the core particles. When the charge control agent is used, it is used in a proportion of generally 0.01 to 10 parts by weight, preferably 0.1 to 5 parts by weight per 100 parts by weight of the polymerizable monomer for shell.

In order to produce the polymerized toner of the core-shell structure, the polymerizable monomer for shell or an aqueous dispersion thereof is added to the suspension containing the core particles in one lot, or continuously or intermittently. It is preferable from the viewpoint of efficient formation of the shell to add a water-soluble radical initiator at the time the polymerizable monomer for shell is added. It is considered that when the water-soluble polymerization initiator is added at the time the polymerizable monomer for shell is added, the water-soluble polymerization initiator enters in the vicinity of each surface of the core particles into which the polymerizable monomer for shell has migrated, so that the polymer layer is easy to be formed on each surface of the core particles.

As examples of the water-soluble polymerization initiator, may be mentioned persulfates such as potassium persulfate and ammonium persulfate; and azo initiators such as 2,2'-azobis[2-methyl-N-(2-hydroxyethyl)propionamide] and 2,2'-azobis-[2-methyl-N-[1,1-bis(hydroxymethyl)ethyl]propionamide. The amount of the water-soluble polymerization initiator used is generally 0.1 to 50% by weight, preferably 1 to 20% by weight per 100 parts by weight of the polymerizable monomer for shell.

The average thickness of the shell is generally 0.001 to 1.0 μm, preferably 0.003 to 0.5 μm, more preferably 0.005 to 0.2 μm. If the thickness of the shell is too great, the fixing ability of the resulting polymerized toner is deteriorated. If the thickness is too small, the storage stability of the resulting polymerized toner is deteriorated. The particle diameters of the core particles and the thickness of the shell in the polymerized toner can be determined by directly measuring the size and shell thickness of each of particles selected at random from electron photomicrographs thereof when they can be observed through an electron microscope. If the core and shell in each particle are difficult to be observed through the electron microscope, the thickness of the shell can be calculated out from the particle diameter of the core particle and the amount of the polymerizable monomer used for forming the shell.

2. Stripping Treatment Step 2

The aqueous dispersion medium containing the polymer particles (colored polymer particles or core-shell type polymer particles) is obtained through Production Step 1. This aqueous dispersion medium is provided as a dispersion as it is, or ion-exchanged water or the like is added to the aqueous dispersion medium for adjusting the concentration of the polymer particles to prepare a dispersion containing the polymer particles. This dispersion is then subjected to a stripping treatment to remove volatile organic components including an unreacted polymerizable monomer, which remain in the polymer particles. The stripping treatment is preferably conducted after completion of the polymerization reaction for reducing the content of the unreacted polymerizable monomer to the utmost. If desired, the stripping treatment may be conducted in the latter half of the polymerization reaction and at a stage that a conversion into a polymer is preferably at least 90%, more preferably at least 95% while continuing the polymerization reaction.

Upon the stripping treatment, an defoaming agent may be added to the dispersion for inhibiting excessive bubbling. Upon the stripping treatment, bubbling occurs on the liquid level of the dispersion containing the polymer particles to form bubbles. When the bubbles excessively increase and overflow an evaporator, a gas circulation line connected to the top of the evaporator is contaminated, or piping is clogged, so that frequent cleaning is required.

As the defoaming agent, may be used a silicone type defoaming agent. However, a non-silicone type defoaming agent is preferably used from the viewpoint of easily providing a polymerized toner having excellent properties. As the non-silicone type defoaming agent, may be mentioned at least one non-silicone type defoaming agent selected from the group consisting of oil and fat type defoaming agents, mineral oil type defoaming agents, polyether type defoaming agents, polyalkylene glycol type nonionic surfactants, emulsified products containing oils and fats and a polyalkylene glycol type nonionic surfactant, and emulsified products containing mineral oil and a polyalkylene glycol type nonionic surfactant. Among these non-silicone type defoaming agents, the mineral oil type defoaming agents, polyalkylene glycol type nonionic surfactants, and emulsified products containing oils and fats and a polyalkylene glycol type nonionic surfactant are preferred from the viewpoints of defoaming effect and toner properties.

These defoaming agents may be selected for use from among various kinds of commercially available defoaming agents and anti-foaming agents. The mineral oil type defoaming agent is modified hydrocarbon oil obtained by using mineral oil as a base, and examples of commercially available products thereof include trade name "DEFOAMING AGENT DF714S" available from SEIKO PMC CORPORATION. As examples of the polyalkylene glycol type nonionic surfactants, may be mentioned polyethylene glycol type nonionic surfactants and polyoxyethylene-polyoxypropylene block copolymer type nonionic surfactants, and examples of commercially available products thereof include trade name "SN DEFOAMER 180" (anti-foaming agent composed of a polyoxyalkylene type nonionic surfactant, trademark) available from SAN NOPCO LIMITED. The emulsified products containing oils and fats and a polyalkylene glycol type nonionic surfactant are those obtained by emulsifying oils and fats with a polyalkylene glycol type nonionic surfactant, and examples of commercially available products thereof include trade name "SN DEFOAMER 1407K" (anti-foaming agent composed of an emulsified product of oils and fats, a polyethylene glycol type nonionic surfactant, etc.) available from SAN NOPCO LIMITED. Examples of commercially available polyether type defoaming agents include polyether type surfactants such as trade names "ADECANOL LG-51" and "ADECANOL LG-109" (trademark) available from ADEKA CORPORATION, and particular polyether compounds such as trade name "UNI-510" available from Ipposha Oil Industries Co., Ltd.

When the non-silicone type defoaming agent is used as the defoaming agent, a polymerized toner having a high charge level can be obtained without adversely affecting the charging property of the polymerized toner.

The solid content concentration in the dispersion containing the polymer particles and supplied to the stripping treatment is within a range of preferably 5 to 45% by weight, more preferably 10 to 40% by weight, particularly preferably 15 to 35% by weight. When a dispersion having a relatively high concentration is obtained in Production Step 1, water such as ion-exchanged water may be added to the dispersion upon the stripping treatment to prepare a dispersion adjusted to a desired solid content concentration.

The amount of the defoaming agent such as the non-silicone type defoaming agent used is preferably 0.01 to 1 part by weight, more preferably 0.05 to 0.5 parts by weight per 100 parts by weight of the polymerizable monomer. If the amount of the defoaming agent used is too small, it may be difficult in some cases to achieve a sufficient defoaming effect. If the amount is too great, there is a possibility that the toner properties may be adversely affected in addition to saturation of the defoaming effect.

In the present invention, the stripping treatment method for the dispersion containing the polymer particles comprises using a method of blowing an inert gas (nitrogen, argon, helium or the like) and a method of blowing saturated steam in combination. A method of conducting stripping under reduced pressure while blowing these gasses into the dispersion may also be adopted.

Upon the stripping treatment, the dispersion is heated, whereby volatilization of volatile organic components including the remaining monomer can be helped to increase the recovery efficiency of the remaining monomer. The temperature of the dispersion upon the stripping treatment is preferably not lower than the glass transition temperature (Tg) of the polymer component forming the polymer particles, but lower than 100° C., more preferably not lower than Tg, but lower than 99° C., still more preferably not lower than (Tg+5° C.), but lower than 95° C. In many cases, the range of 70 to 99° C. can yield good results. The glass transition temperature is a value measured by a differential scanning calorimeter (DSC). When the polymer component has 2 or more Tgs, the lowest Tg is regarded as reference. Upon the stripping treatment, it is desirable that heating conditions and the flow rates of both inert gas and saturated steam are controlled in such a manner that the temperature of the dispersion is kept almost constant at a desired temperature within the above range.

The dispersion is heated by means of an evaporator (evaporating tank) provided with a heat medium-circulating jacket, an evaporator provided with a heat exchanger in the interior thereof, or an evaporator connected to an external heat exchanger. The dispersion may also be heated by blowing a heated gas thereinto. If the temperature of the dispersion is too low, evaporation of the dispersion by the stripping treatment becomes insufficient, and the migration of the remaining monomer in the polymer particles becomes slow, and so the removal rate of the remaining monomer is lowered. If the temperature of the dispersion is too high, the dispersion stability of the polymer particles is deteriorated, so that aggregates occur during the treatment, or adhesion of scale to the wall of the evaporator and an agitator increases.

The pressure of a vapor phase within the evaporator may be suitably determined according to a specific method of the stripping treatment. However, it is preferably selected from within a range of generally 5 to 80 kPa. When the method of conducting stripping under reduced pressure while blowing the gasses is adopted, the pressure within the evaporator is desirably controlled within a range of preferably 5 to 70 kPa, more preferably 10 to 65 kPa, particularly preferably 20 to 60 kPa.

The stripping treatment time varies according to the scale of a treatment apparatus, a treated amount, a specific treating method, a desired level of the content of the total volatile organic components, etc. However, the treatment time is selected from within a range of generally 0.5 to 50 hours, preferably 1 to 30 hours, more preferably 2 to 20 hours. In many cases, good results can be yielded by the stripping treatment for a short period of time of not shorter than 2 hours, but shorter than 10 hours, further about 3 to 6 hours.

An agitator is preferably arranged within the evaporator to conduct the stripping treatment while agitating the dispersion. No particular limitation is imposed on the agitator. However, the agitator is preferably equipped with agitating blades such as wide puddle blades, wide graded blades, Bullmargin blades or modified blades thereof, full zone blades, or wall wetter blades. A part of the agitating blades may also be projected from the liquid level of the dispersion. Conditions for agitation in the stripping treatment are such that the rotating speed of the agitating blade is preferably 1 to 50 revolutions/min, more preferably 2 to 40 revolutions/min.

By the stripping treatment, a part of the aqueous dispersion medium in the dispersion, the remaining monomer contained in the dispersion, the remaining monomer in the polymer particles, other volatile compounds, and the like are removed. The dispersion within the evaporator may be concentrated by the stripping treatment, and, if desired, an aqueous dispersion may be newly added for supplementing the aqueous dispersion medium evaporated. However, according to the method of the present invention, the stripping treatment can be conducted efficiently without adding the supplemental aqueous dispersion medium because the saturated steam is blown into the dispersion. The remaining monomer and aqueous dispersion medium can be collected and reused.

FIG. 1 illustrates an exemplary stripping treatment system, which can be suitably adopted in the method of the present invention. An agitator equipped with agitating blades 2 is arranged in an evaporator 1. A heat medium-circulating jacket (not illustrated) is preferably provided on the outer wall of the evaporator 1 in such a manner that the temperature within the evaporator can be controlled to a desired temperature. In the evaporator 1, are arranged a non-contact type bubble level meter 3, a pressure gauge 4 and a thermometer 5.

In the specific example illustrated in FIG. 1, the system is so constructed that flows of nitrogen gas and steam are put together through a valve 15 and a line 13 from an $N_2$ source (inert gas source) 16 and a steam source (saturated steam source) 17, and these gasses are blown simultaneously into the dispersion from a single blowing tube (inlet tube) 14.

A blower 12 is operated, whereby the confluent gas of the nitrogen gas and steam is blown into the dispersion from the blowing tube 14. A vacuum pump may also be used in place of the blower. While agitating the dispersion (not illustrated) within the evaporator 1 by the agitating blades 2 of the agitator, the temperature of the dispersion is raised to a predetermined temperature, and the confluent gas of the nitrogen gas and steam is then blown into the dispersion from the opening of the blowing tube 14 by operating the blower 12. The nitrogen gas, steam, a part of the aqueous dispersion medium in the dispersion, the remaining monomer, and other volatile compounds are guided to a condenser 7 through a gas line 6, and then guided to a condensing tank 8. Liquid components such as water, which have been condensed and liquified within the condensing tank 8, are recovered therein (a recovering line is not illustrated).

Gas components, from which the liquid components have been removed, are preferably guided to a volatile substance-removing device 10 through a gas line 9. The volatile substance-removing device 10 is, for example, an adsorbing column packed with active carbon, or a bubbling device containing cold water, where the monomer and other volatile components are removed. Thereafter, the gas components are discharged from the blower 12 through a gas line 11. The inert gas such as nitrogen gas may be recycled within the evaporator 1 through a gas circulating line (not illustrated) to reuse it.

A non-contact type bubble level meter 3 is provided at an upper portion within the evaporator 1. The non-contact type bubble level meter 3 is preferably a microwave type level meter. This microwave type level meter is a measuring device for determining a level by measuring a distance between a reference position of a transmitter provided and a surface of a measuring object making use of the fact that the time required for reciprocating a microwave is proportional to a measured distance on the basis of the principle of frequency modulation (FM)-continuous wave (CW) radar. The microwave type level meter is only fitted to a fixing nozzle on the tank, whereby the level of the object to be measured can be measured with high precision without contacting with the object. This microwave type level meter can be used for measurement of a level of a bubble layer generated at a gas-liquid interface of the dispersion containing the polymer particles.

In the stripping treatment step, the temperature of the inert gas blown into the dispersion is preferably controlled within a range of 50 to 100° C. The temperature of the inert gas is preferably controlled within a range of more preferably 60 to 95° C., still more preferably 70 to 90° C. In order to heat the inert gas, it is only necessary to heat the inert gas source or the inert gas line. The flow rate of the inert gas blown into the dispersion is preferably controlled within a range of 0.05 to 4 L/(hr·kg). The flow rate of the inert gas is more preferably 0.5 to 3.5 L/(hr·kg). The flow rate of the inert gas is a flow rate per kg of the polymer (or the polymerizable monomer composition used) contained in the dispersion. From the viewpoints of efficiency of the stripping treatment and prevention of aggregation or fusion of the polymer particles, both temperature and flow rate of the inert gas are preferably controlled within the above-described respective ranges.

In the stripping treatment step, the temperature of the saturated steam blown into the dispersion is preferably controlled within a range of 90 to 180° C. The temperature of the saturated steam is preferably controlled within a range of more preferably 95 to 155° C., still more preferably 98 to 130° C. The flow rate of the saturated steam blown into the dispersion is preferably controlled within a range of 0.05 to 1 kg/(hr·kg). The flow rate of the saturated steam is more preferably 0.07 to 0.8 kg/(hr·kg), still more preferably 0.08 to 0.5 kg/(hr·kg). The flow rate of the saturated steam is a flow rate per kg of the polymer (or the polymerizable monomer composition used) contained in the dispersion. From the viewpoints of efficiency of the stripping treatment and prevention of aggregation or fusion of the polymer particles, both temperature and flow rate of the saturated steam are preferably controlled within the above-described respective ranges. The saturated steam means steam in which water and steam coexist in an equilibrium state.

In the present invention, the stripping treatment is conducted by using both inert gas and saturated steam in combination, whereby the content (TVOC content) of total volatile organic components contained in the polymerized toner can be markedly reduced compared with the case of single use thereof. In addition, according to the method of the present invention, a polymerized toner markedly improved in printing durability under a normal-temperature and normal-humidity environment and a high-temperature and high-humidity environment and inhibited in occurrence of vertical stripes on printing paper can be obtained.

In case of single use of the inert gas, only a polymerized toner having a TVOC content exceeding 200 ppm can be obtained in the collecting step after the stripping treatment step under the ordinary treatment conditions. In case of single use of the saturated steam, only a polymerized toner having a TVOC content exceeding 300 ppm can be obtained in the collecting step after the stripping treatment step under the ordinary treatment conditions.

On the other hand, according to the method of the present invention, polymer particles having a TVOC content of preferably at most 150 ppm, more preferably at most 140 ppm can be collected in the collecting step after the stripping treatment step. The lower limit of the TVOC content is generally 10 ppm or 20 ppm.

When saturated steam of a high temperature is blown into the dispersion over a long period of time, aggregation or fusion of the polymer particles is easy to occur, and difficulty is encountered on control of the temperature and amount of the dispersion. The method of continuously blowing the saturated steam of the high temperature into the dispersion to keep the temperature of the dispersion at 100° C. easily causes fusion of polymer particles or change of surface properties thereof. On the other hand, according to the method of the present invention, the amount of the saturated steam blown can be reduced because both blowing of the inert gas and blowing of the saturated steam are used in combination, whereby these various problems can be relieved or overcome. The inert gas and saturated steam are used in combination, whereby the stripping treatment can be stably performed without causing the problem of aggregation or fusion by reducing the amount of the saturated steam blown even when the polymerized toner is designed to be a low-temperature fixing type.

The inert gas and saturated steam are used in combination, and the flow rate of the inert gas is mainly changed, thereby permitting rapidly coping with variations in the level of a bubble layer generated on the liquid level of the dispersion. According to the method of using the saturated steam singly, it is difficult to lower the level of the bubble layer to an allowable height when the level of the bubble layer rapidly becomes too high even if the amount of the saturated steam blown is reduced, since the temperature of the dispersion cannot be rapidly lowered.

The method of the present invention not only can prevent the level of the bubble layer from becoming excessively high due to, for example, addition of a defoaming agent, but also can increase the removal efficiency of the volatile organic components by heightening the level of the bubble layer to an allowable height. When the level of the bubble layer becomes too high or too low, the flow rate of the inert gas is mainly controlled, whereby the level of the bubble layer can be controlled to a desired level. Contamination of an apparatus and clogging of piping by adhesion of bubbles can be thereby prevented to relieve the necessity of cleaning.

When a stripping treatment is conducted by blowing a gas such as an inert gas or saturated steam into the dispersion, the level of the bubble layer at the initial stage of the stripping treatment often becomes a maximum value. Therefore, when the gas is blown at a fixed flow rate from the beginning to conduct the treatment, the level of the bubble layer is gradually lowered. When the level of the bubble layer is lowered, it is possible to vary conditions for the stripping treatment so as to increase the removal efficiency of the volatile organic components by, for example, increasing the flow rate of the gas. In order to increase the removal efficiency of the volatile organic components including the remaining monomer, the dispersion is sufficiently bubbled to heighten the level of the bubble layer on the liquid level of the dispersion, resulting in accelerating volatilization and migration into bubbles of the volatile organic components at a gas-liquid interface. Accordingly, the level of the bubble layer is desirably heightened within an allowable range, not lowered to the utmost.

When the bubble level during the stripping treatment is detected by a bubble level meter such as a non-contact type bubble level meter, the conditions for the stripping treatment can be controlled on the basis of the bubble level information detected. When the lowering of the level of the bubble layer is known by the bubble level information, for example, the flow rate of the gas can be increased corresponding to the lowering. It is preferable to increase the flow rate of the gas blown in the dispersion step by step or continuously under conditions that the level of the bubble layer on the liquid level of the dispersion stays in a vapor phase within the evaporator.

When the flow rate of the saturated steam of the high temperature is increased corresponding to the lowering of the level of the bubble layer, the aggregation or fusion of the polymer particles is easy to occur, and the temperature and amount of the dispersion are increased. On the other hand, when the method of using the inert gas and saturated steam in combination is adopted, the level of the bubble layer can be rapidly kept to a predetermined height by controlling both flow rates or mainly controlling the flow rate of the inert gas.

The level of the bubble layer is indicated as a bubble layer level (%) by expressing the height of bubbles from the bottom by percent on the basis of the height (100%) of the evaporator. When the liquid level of the dispersion within the evaporator is located at a position of 60% of the height thereof, the level of the bubble layer comes to exceed 60%. A case where the level of the bubble layer is 100% is under the conditions that the bubble level on the liquid level of the dispersion stays in the vapor phase within the evaporator. However, in order not to contaminate an exhaust line, a condenser, etc. with bubbles, the level of the bubble layer is desirably controlled to generally at most 95%, preferably at most 90%, more preferably at most 85%. On the other hand, the level of the dispersion is controlled to generally at most 80%, preferably at most 70%, more preferably at most 60% on the basis of the height (100%) of the evaporator. The lower limit thereof is about 40% or 50%.

In the present invention, it is desirable to adopt a method, in which the dispersion is subjected to the stripping treatment within the evaporator in the stripping treatment step, and the conditions for the stripping treatment are controlled in such a manner that the level of the bubble layer on the liquid level of the dispersion does not exceed 95% based on the height of the evaporator, and the lowering of the bubble level from the beginning of the stripping treatment is within 10%. The lowering rate of the level of the bubble layer is also a value based on the height of the evaporator.

The flow rate of the inert gas is preferably increased step by step or continuously as the stripping treatment step proceeds. A ratio of an average flow rate in the latter half of the stripping treatment step to an average flow rate of the former half of the stripping treatment step is within a range of preferably 1.05 to 10, more preferably 1.2 to 6, particularly preferably 1.5 to 5.

The inert gas and saturated steam may be blown into the dispersion as independent separate flows. Alternatively, both flows may be put together and blown into the dispersion as one flow. In order to blow the inert gas and saturated steam into the dispersion as independent separate flows, two blowing tubes are provided at the bottom of the evaporator. In order to put the inert gas and saturated steam together and blow them into the dispersion as one flow, one blowing tube is provided at the bottom of the evaporator.

These gasses may be blown into the dispersion according to a method that a blowing tube is formed into a double-tube structure, and the inert gas and saturated steam are passed through the inner tube and the outer tube thereof, respectively. When the heights at the outlets of the inner tube and outer tube in the blowing tube of the double-tube structure are made even, both gasses are put together at the outlets. When the height at the outlet of the inner tube in the blowing tube of the double-tube structure is projected, both gasses are not put together at the outlets, or the time both gasses are put together can be slowed.

When the method of putting the inert gas and saturated steam together to blow them into the dispersion is adopted, the aggregation or fusion of the polymer particles and the change of surface properties thereof can be relieved compared with the case where the saturated steam is blown into the dispersion as a separate flow. The reason for it is that the degree of contact of the saturated steam of the high temperature with the polymer particles in the dispersion is lowered.

When the inert gas is continuously blown, a strainer arranged in the blowing tube is easy to cause clogging. However, when the method of putting the inert gas and saturated steam together to blow them from one blowing tube is adopted, the clogging of the strainer can be relieved or prevented without lowering the function thereof. According to this method, an already existing evaporator, in which one blowing tube has been arranged, can be used, which is economical and also useful in retaining the strength of the evaporator.

3. Collecting Step 3

The polymer particles are collected from the dispersion after Stripping Treatment Step 2. The collection of the polymer particles is conducted by dehydrating, washing, filtering and drying treatments in accordance with a method known per se in the art, whereby dry polymer particles are collected. Prior to the dehydration, for example, a treatment such as acid washing or alkali washing according to the kind of the dispersion stabilizer used is conducted for the purpose of solubilizing and removing the dispersion stabilizer.

The volume average particle diameter of the polymerized toner (including the capsule toner having the core-shell type structure) according to the present invention is generally 1 to 12 μm, preferably 2 to 11 μm, more preferably 3 to 10 μm. When resolution is enhanced to provide a high-definition image, the volume average particle diameter of the toner can be made small up to preferably 2 to 9 μm.

A particle diameter distribution represented by [the volume average particle diameter (Dv)/the number average particle diameter (Dn)] of the polymerized toner according to the present invention is generally at most 1.7, preferably at most 1.5, more preferably at most 1.3. If the volume average particle diameter of the polymerized toner is too great, the resolution of an image formed with such a toner is liable to be deteriorated. If the particle diameter distribution of the polymerized toner is too great, the proportion of a toner having a great particle diameter increases, and so the resolution is easy to be deteriorated.

The polymerized toner according to the present invention is preferably substantially spherical as demonstrated by a spheroidicity represented by a ratio (dl/ds) of the length (dl) to the breadth (ds) of preferably 1 to 1.3, more preferably 1 to 1.2. When a substantially spherical polymerized toner is used as a non-magnetic one-component developer, the transfer efficiency of a toner image on a photosensitive member to a transfer material is improved.

The polymerized toner according to the present invention may be used as a toner component for various kinds of developers. However, it is preferably used as a non-magnetic one-component developer. When the polymerized toner according to the present invention is used as the non-magnetic one-component developer, an external additive may be mixed as needed. Examples of the external additive include inorganic particles and organic resin particles functioning as a flowability improver, an abrasive and/or the like.

Examples of the inorganic particles include silicon dioxide (silica), aluminum oxide (alumina), titanium oxide, zinc oxide, tin oxide, barium titanate and strontium titanate. Examples of the organic resin particles include particles of methacrylic ester polymers, acrylic ester polymers, styrene-methacrylic ester copolymers and styrene-acrylic ester copolymers, and core-shell type particles in which the core is composed of a styrene polymer, and the shell is composed of a methacrylic ester copolymer.

Among these, the inorganic oxide particles are preferred, with silicon dioxide being particularly preferred. The surfaces of the inorganic fine particles may be subjected to a hydrophobicity-imparting treatment, and silicon dioxide particles subjected to the hydrophobicity-imparting treatment are particularly preferred. Two or more of the external additives may be used in combination. When the external additives are used in combination, it is preferable to use two or more kinds of inorganic particles or inorganic particles and organic resin particles, which are different in average particle diameter from each other, in combination. No particular limitation is imposed on the amount of the external additive used. However, it is generally 0.1 to 6 parts by weight per 100 parts by weight of the polymerized toner. In order to attach the external additive to the polymerized toner, the polymerized toner and the external additive are generally charged into a mixer such as a Henschel mixer to agitate them.

EXAMPLES

The present invention will hereinafter be described in more detail by the following Examples and Comparative Examples. However, the present invention is not limited to the following examples only. All designations of "part" or "parts" and "%" mean part or parts by weight and % by weight unless expressly noted. Testing methods and evaluating methods are as follows.

(1) Measurement of TVOC Content:

The content (TVOC content) of total volatile organic components was determined in accordance with the purge & trap/gas chromatography (P&T/GC) method. In a purging container was placed 0.1 g of a toner for development of electrostatic images, and the purging container was heated from room temperature at a heating rate of 10° C./min while introducing helium gas as a carrier gas at a flow rate of 50 mL/min. At the time the temperature of the purging container had reached 230° C., the container was held for 10 minutes at that temperature. A volatile component generated by heating was collected in a trap tube at −130° C. After the collection, the temperature of the purging container was returned to room temperature. The trap tube, in which the volatile component had been collected, was then heated from −130° C. to 280° C. at a heating rate of 50° C./min to conduct determination of the volatile component under the following conditions by means of gas chromatography, thereby determining the content of total volatile organic components.

A measuring apparatus was a GAS CHROMATOGRAPH 6890 (FID method) manufactured by Agilent Co., and a SHIMADZU C-R7A CHROMATOPACK, a purge & trap sampler (TDS, manufactured by Agilent Co.), and a column (manufactured by J&W Co., DB-5; L=30 m, I.D=0.32 mm; film=0.25 μm) were used to conduct the measurement under the following conditions.

Column temperature: 50° C. (held for 2 minutes) to 270° C. (heated at a rate of 10° C./min), Sample charging temperature: 280° C., Detection temperature: 280° C., Carrier gas: helium gas, flow rate: 1 mL/min.

(2) Measurement of Particle Diameter:

The volume average particle diameter Dv and particle diameter distribution represented by a ratio Dv/Dn of volume average particle diameter Dv to number average particle diameter Dn of each polymer particle sample are measured by means of a particle diameter meter (manufactured by Beckmann Coulter Co., trade name: MULTISIZER). The measurement was conducted under conditions of an aperture diameter=100 μm, a medium=Isothone II, a concentration=10% and the number of particles measured=100,000 particles.

(3) Measurement of Glass Transition Temperature:

A differential scanning calorimeter (DSC) was used to measure the glass transition temperature of each toner.

(4) Printing Durability Test:

A polymerized toner was charged into a commercially available printer [printing speed: 18 sheets (A4-sized paper)/min] of a nonmagnetic one-component development system, the printer was left to stand for a day under an environment (NN environment) of 23° C. in temperature and 50% in humidity, and continuous printing was then conducted under the same NN environment at a printing density of 1%. The printing was once stopped every 1,000 sheets of paper to measure fog.

The number of paper sheets printed until the following fog ΔE reached at least 1 was regarded as the number (measured in a unit of 1,000 sheets) of paper sheets printed up to occurrence of fog under NN environment. The fog was determined in the following mariner. White solid printing (printing of an image originally ought not to be printed) was first conducted on paper for printing, and the printer was stopped in the middle of the white solid printing. A toner remaining in a non-image area on a photosensitive member after development was peeled off with a pressure-sensitive adhesive tape (product of Sumitomo 3M Limited, trade name: SCOTCH MENDING TAPE 810-3-18, trademark). This pressure-sensitive adhesive tape was stuck on new paper for printing to measure a color tone at a portion applied with the toner of the non-image area by means of a spectroscopic color-difference meter (manufactured by Nippon Denshoku K.K., trade name: SE-2000). An unused pressure-sensitive adhesive tape was stuck as a reference on new paper for printing to measure a color tone likewise. Their color tones were represented as coordinates of the L*a*b* color space to calculate out a color difference ΔE from the color tones of the measured sample and reference sample to regard it as a fog value. The smaller fog value indicates that fog is less, and image quality is better.

The printing was once stopped every 1,000 sheets of paper, and black solid printing was conducted to visually observe the condition of occurrence of vertical stripes on the solid image. The number of paper sheets printed until the vertical stripes occurred was regarded as the number of paper sheets printed up to occurrence of vertical stripes. The same printing durability test was also conducted under an environment (HH environment) of 35° C. in temperature and 80% in humidity to determine the number of paper sheets printed up to occurrence of fog under HH environment. In Table 2, the indication of ">" in the number of paper sheets printed up to occurrence of vertical stripes indicates that no vertical stripe occurred even at the time fog occurred.

Example 1

(1) Preparation Step of Polymerizable Monomer Composition

A polymerizable monomer mixture composed of 80.5 parts of styrene and 19.5 parts of n-butyl acrylate, 0.25 parts of a polymethacrylic ester macromonomer (product of Toagosei Co., Ltd., trade name: AA6, Tg: 94° C.), 0.5 parts of divinylbenzene, 0.1 parts of t-dodecylmercaptan, 7 parts of carbon black (product of Mitsubishi Chemical Corporation, trade name: "#25"), 1 part of a charge control agent (styrene/acrylic resin, product of Fujikura Kasei Co., Ltd., trade name: FCA-207P) and 2 parts of Fischer-Tropsch wax as a parting agent (product of Sasol Ltd., trade name: "PARAFLINT SPRAY 30", trademark, endothermic peak temperature: 100° C.) were subjected to wet grinding by means of a media type wet grinding machine to prepare a polymerizable monomer composition.

(2) Preparation Step of Aqueous Dispersion Medium

An aqueous solution with 6.2 parts of sodium hydroxide dissolved in 50 parts of ion-exchanged water was added to an aqueous solution with 10.2 parts of magnesium chloride dissolved in 215 parts of ion-exchanged water under stirring to form colloid of magnesium hydroxide, which was colloid of a hardly water-soluble metal hydroxide, thereby preparing an aqueous dispersion medium. The particle diameter distribution of the colloid formed was measured by means of a particle diameter distribution measuring device (manufactured by Nikkiso Co., Ltd., trade name: MICROTRAC). As a result, the particle diameter thereof was 0.35 μm in terms of $D_{50}$ (50% cumulative value of number particle diameter distribution) and 0.84 μm in terms of $D_{90}$ (90% cumulative value of number particle diameter distribution). The measurement by this MICROTRAC particle diameter distribution measuring device was conducted under conditions of a measuring range=0.12 to 704 μm, a measuring time=30 seconds and a medium=ion-exchanged water.

(3) Preparation Step of Aqueous Dispersion of Polymerizable Monomer for Shell One part of methyl methacrylate (Tg of homopolymer: 105° C.) and 100 parts of water were subjected to a finely dispersing treatment by an ultrasonic emulsifier to obtain an aqueous dispersion of a polymerizable monomer for shell. The droplet diameter of droplets of the polymerizable monomer for shell was measured by means of the MICROTRAC particle diameter distribution measuring device by adding the droplets thus obtained at a concentration of 3% to a 1% aqueous solution of sodium hexametaphosphate. As a result, the $D_{90}$ thereof was 1.6 μM.

(4) Droplet-Forming Step

The polymerizable monomer composition prepared in the step (1) was poured into the aqueous dispersion medium containing the magnesium hydroxide colloid obtained in the step (2), and the mixture was stirred. After 6 parts of t-butyl peroxy-2-ethylhexanoate (product of Nippon Oil & Fats Co., Ltd., trade name: PERBUTYL O, trademark) was then added as a polymerization initiator to the aqueous dispersion medium, the resultant dispersion was stirred under high shear by means of an in-line type emulsifying and dispersing machine (manufactured by Ebara Corporation, trade name: EBARA MILDER, trademark) to form fine droplets of the polymerizable monomer composition in the aqueous dispersion medium. In such a manner, an aqueous dispersion with the droplets of the polymerizable monomer composition dispersed therein was prepared.

(5) Polymerization Step

A reactor equipped with agitating blades was charged with the aqueous dispersion with the polymerizable monomer dispersed therein, which had been prepared in the step (4), and the temperature was raised to 90° C. to conduct a polymerization reaction. The polymerization reaction was conducted until a conversion into a polymer reached almost 100%. At that point of time, an aqueous dispersion with 0.1 parts of 2,2'-azobis[2-methyl-N-(2-hydroxyethyl)-propionamide] (product of Wako Pure Chemical Industries, Ltd., trade name: VA-086) as a water-soluble initiator dissolved therein was added to the aqueous dispersion of the polymerizable monomer for shell prepared in the step (3). After the reaction was continued for 4 hours, the reaction mixture was cooled to stop the reaction, thereby obtaining an aqueous dispersion (hereinafter referred to as "polymer particle dispersion") containing core-shell type colored polymer particles formed. The solid content concentration of this polymer particle dispersion was 27%.

(6) Stripping Treatment Step

The system illustrated in FIG. 1 was used to subjecting the polymer particle dispersion obtained in the step (5) to a stripping treatment. A microwave type level meter (manufactured by TOKIMEC INC., trademark: LEVELPRO RTG-40) was provided at an upper portion within an evaporator 1, and this was used as a non-contact type bubble level meter 3. After the polymer particle dispersion was diluted to a solid content concentration of 20% with ion-exchanged water, the diluted dispersion was fed to the evaporator 1.

Into the evaporator 1 were added 0.1 part of a defoaming agent (product of SAN NOPCO LIMITED, trade name: SN DEFOAMER 180, trademark; an emulsified product of oils and fats, a polyoxyalkylene type nonionic surfactant, etc.) and 10 parts of the same aqueous dispersion medium as the aqueous dispersion medium prepared in the step (2). Nitrogen gas was introduced into the evaporator 1 to purge a vapor phase thereof with the nitrogen gas. After the polymer particle dispersion was then heated up to 75° C. while agitating at an agitating speed of 20 rpm by agitating blades 2, a blower 12 was started. At this time, the level of the dispersion within the evaporator was 60%.

Nitrogen gas was heated to 80° C. by a heater to adjust the flow rate of the nitrogen gas to 1.0 L/(hr·kg). Steam (saturated steam) of 100° C. was adjusted in such a manner that the flow rate thereof became 0.1 kg/(hr·kg). A confluent gas of the steam and nitrogen gas was introduced into the polymer particle dispersion from a blowing tube (gas inlet) 14 of a straight type to start a stripping treatment. The confluent gas blown is guided to a condenser 7 through a gas line 6.

The stripping treatment was conducted under conditions that the temperature of the polymer particle dispersion was 75° C., the pressure of the vapor phase within the evaporator 1 was 60 kPa, and the flow rate (average flow rate in the former half of the time during which the stripping treatment step was conducted) of the nitrogen gas in the former half of the stripping treatment step was 1.0 L/(hr·kg). Since the level of a bubble layer on the liquid level of the dispersion went down as the treatment time elapsed, the flow rate of the nitrogen gas was increased step by step. The flow rate of the nitrogen gas in the latter half of the stripping treatment step was controlled to 3.0 L/(hr·kg). With the increase of the flow rate of the nitrogen gas, the flow rate of the nitrogen gas was controlled in such a manner that the bubble level was under bubble level conditions (at most 95%) staying in the vapor phase within the evaporator, and was preferably a bubble level (at least 90%) that was within a range causing no inconvenience in operation and could retain a high removing capability.

While controlling the flow rate of the nitrogen gas in this manner, the stripping treatment step was conducted for 5.5 hours. Thereafter, the resultant aqueous dispersion was cooled to 25° C. Colored polymer particles obtained after the stripping treatment step were sampled to measure a TVOC content at the time the stripping had been completed.

(7) Collecting Step

After completion of the step (6), sulfuric acid was added while agitating the dispersion of the polymer particles to conduct acid washing (at 25° C. for 10 minutes), thereby adjusting the pH of the dispersion to 4.5 or lower. This dispersion was dewatered and washed by means of a continuous belt filter (manufactured by Sumitomo Heavy Industries, Ltd., trade name: EAGLE FILTER) to filter and separate solids. The solids were dried at 45° C. for 10 hours by a dryer to obtain polymer particles (core-shell type polymer particles) having a volume average particle diameter Dv of 8.9 μm and a particle diameter distribution Dv/Dn of 1.14.

To 100 parts of the dried polymer particles were added 0.8 parts of fine particles (product of Cabot Co., trade name: TG820F) subjected to a hydrophobicity-imparting treatment and 1 part of fine particles (product of Nippon Aerosil Co., Ltd., trade name: NA50Y) subjected to a hydrophobicity-imparting treatment, and these components were mixed by means of a Henschel mixer to attach these particles to the surfaces of the polymer particles, thereby obtaining a toner (non-magnetic one-component toner) for development of electrostatic images. The test results of the thus-obtained toner are shown collectively in Tables 1 and 2.

Example 2

A polymerized toner was produced in the same manner as in Example 1 except that 2 parts of the parting agent, Fischer-Tropsch wax, in (1) Preparation step of polymerizable monomer composition of Example 1 was changed to 5 parts of dipentaerythritol hexamyristate (solubility in styrene: 10 g/100 g or higher, endothermic peak: 65° C., molecular weight: 1,514), 0.1 parts of t-dodecyl-mercaptan was changed to 0.75 parts of tetraethylthiuram disulfide, 0.5 parts of divinylbenzene was changed to 0.65 parts of divinylbenzene, 6 parts of the polymerization initiator, t-butyl peroxy-2-ethylhexanoate, in (4) Droplet-forming step of Example 1 was changed to 5 parts of t-butyl peroxy-2-ethylbutanoate (product of AKZO NOBEL CO., trade name: TRIGONOX 27, trademark, purity: 98%, molecular weight: 188, 1-hour half-life temperature: 94° C., 10-hour half-life temperature: 75° C.), the pressure of the evaporator in (6) Stripping treatment step of Example 1 was changed to 50 kPa from 60 kPa, and the flow rate of the nitrogen gas in the latter half of the stripping treatment step was changed to 2.0 L/(hr·kg) from 3.0 L/(hr·kg). The results are shown in Tables 1 and 2.

Example 3

A polymerized toner was produced in the same manner as in Example 2 except that the polymerizable monomer mixture composed of 80.5 parts of styrene and 19.5 parts of n-butyl acrylate in (1) Preparation step of polymerizable monomer composition of Example 2 was changed to a polymerizable monomer mixture composed of 78 parts of styrene and 22 parts of n-butyl acrylate, the temperature of the dispersion subjected to the stripping treatment step in (6) Stripping treatment step of Example 1 was changed to 85° C. from 75° C., the pressure of the evaporator upon the stripping treatment step was changed to 40 kPa from 60 kPa, the flow rate of the saturated steam was changed to 0.2 kg/(hr·kg) from 0.1 kg/(hr·kg), and the time of the stripping treatment step was changed to 4 hours from 5.5 hours. The results are shown in Tables 1 and 2.

Comparative Example 1

A polymerized toner was produced in the same manner as in Example 1 except that only nitrogen gas was used without using the confluent gas of the nitrogen gas and saturated steam in (6) Stripping treatment step of Example 1. The results are shown in Tables 1 and 2.

Comparative Example 2

A polymerized toner was produced in the same manner as in Example 1 except that only saturated steam was introduced at a flow rate of 0.15 kg/(hr·kg) without using the confluent gas of the nitrogen gas and saturated steam in (6) Stripping treatment step of Example 1, the temperature of the dispersion subjected to the stripping treatment step in (6) Stripping treatment step of Example 1 was changed to 80° C. from 75° C., the pressure of the evaporator was changed to 40 kPa from 60 kPa, and the time of the stripping treatment step was changed to 10 hours from 5.5 hours. The results are shown in Tables 1 and 2.

TABLE 1

| | Example | | | Comp. Example | |
|---|---|---|---|---|---|
| | 1 | 2 | 3 | 1 | 2 |
| Monomer composition for core (parts) | | | | | |
| Styrene | 80.5 | 80.5 | 78 | 80.5 | 80.5 |
| n-Butyl acrylate | 19.5 | 19.5 | 22 | 19.5 | 19.5 |
| Macromonomer | 0.25 | 0.25 | 0.25 | 0.25 | 0.25 |
| Divinylbenzene | 0.5 | 0.65 | 0.65 | 0.5 | 0.5 |
| Molecular weight modifier | | | | | |
| t-TDM | 0.1 | — | — | 0.1 | 0.1 |
| TETDS | — | 0.75 | 0.75 | — | — |

TABLE 1-continued

| | Example | | | Comp. Example | |
|---|---|---|---|---|---|
| | 1 | 2 | 3 | 1 | 2 |
| Carbon black | 7 | 7 | 7 | 7 | 7 |
| Charge control agent | 1 | 1 | 1 | 1 | 1 |
| Parting agent | | | | | |
| Wax | 2 | — | — | 2 | 2 |
| Fatty acid ester | — | 5 | 5 | — | — |
| Polymerization initiator | | | | | |
| PERBUTYL O | 6 | — | — | 6 | 6 |
| TRIGONOX 27 | — | 5 | 5 | — | — |
| Monomer for shell (parts) | | | | | |
| Methyl methacrylate | 1 | 1 | 1 | 1 | 1 |

(Note)

(1) t-TDM: t-Dodecylmercaptan (2) TETDS: Tetraethylthiuram disulfide (3) Charge control agent: Trade name FCA-207P, quaternary ammonium (salt) group-containing styrene/acrylic resin type charge control resin (4) Wax: Fischer-Tropsch wax (product of Sasol Ltd., trade name: "PARAFLINT SPRAY 30", trademark, endothermic peak temperature: 100° C.)

(5) Fatty acid ester: Dipentaerythritol hexamyristate (solubility in styrene: 10 g/100 g or higher, endothermic peak: 65° C., molecular weight: 1,514)

(6) PERBUTYL O: t-Butyl peroxy-2-ethylhexanoate (product of Nippon Oil & Fats Co., Ltd., trade name: PERBUTYL O, trademark)

(7) TRIGONOX 27: t-Butyl peroxy-2-ethylbutanoate (product of AKZO NOBEL CO., trade name: TRIGONOX 27, trademark, purity: 98%, molecular weight: 188, 1-hour half-life temperature: 94° C., 10-hour half-life temperature: 75° C.)

TABLE 2

| | Example | | | Comp. Example | |
|---|---|---|---|---|---|
| | 1 | 2 | 3 | 1 | 2 |
| Stripping treatment | | | | | |
| Defoaming agent (parts) | 0.1 | 0.1 | 0.1 | 0.1 | 0.1 |
| Temperature of dispersion treated (° C.) | 75 | 75 | 85 | 75 | 80 |
| Pressure of vapor phase (kPa) | 60 | 50 | 40 | 60 | 40 |
| Nitrogen gas | | | | | |
| Temperature (° C.) | 80 | 80 | 80 | 80 | — |
| Flow rate [L/(hr · kg)] | | | | | |
| Former half | 1 | 1 | 1 | 1 | — |
| Latter half | 3 | 2 | 3 | 3 | — |
| Saturated steam | | | | | |
| Temperature (° C.) | 100 | 100 | 100 | — | 100 |
| Flow rate [kg/(hr · kg)] | 0.1 | 0.1 | 0.2 | — | 0.15 |
| Treatment time (hr) | 5.5 | 5.5 | 4 | 5.5 | 10 |
| Polymerized toner | | | | | |
| TVOC value (ppm) | 135 | 90 | 45 | 227 | 343 |
| Volume average particle diameter (μm) | 8.9 | 8.8 | 8.8 | 8.9 | 8.9 |
| Particle diameter distribution (Dv/Dn) | 1.14 | 1.14 | 1.13 | 1.14 | 1.14 |
| Glass transition temperature (° C.) | 60 | 58 | 56 | 60 | 60 |
| Fixing temperature (° C.) | 190 | 175 | 165 | 190 | 185 |
| HH printing durability (sheets) | 12000 | 12000 | 14000 | 8000 | 6000 |
| NN printing durability (sheets) | 13000 | 15000 | 16000 | 10000 | 9000 |
| Paper sheets printed up to occurrence of vertical stripes under NN | >13000 | >15000 | >16000 | 6000 | >9000 |

(Note)

(1) HH printing durability: Printing durability test under an environment (HH environment) of 35° C. in temperature and 80% in humidity (2) NN printing durability: Printing durability test under an environment (NN environment) of 23° C. in temperature and 50% in humidity (3) Paper sheets printing up to occurrence of vertical stripes under NN: The number of paper sheets printed until vertical stripes occur in the printing durability test under an environment (NN environment) of 23° C. in temperature and 50% in humidity

[Consideration]

In Comparative Example 1, in which the stripping treatment was conducted by blowing nitrogen gas alone, the TVOC value was 227 ppm, and vertical stripes occurred at the time the continuous printing had been conducted on 6,000 paper sheets in the printing durability test under the NN conditions. In addition, in case of Comparative Example 1, the number of paper sheets continuously printed up to occurrence of fog was 8,000 sheets under the FIR environment and 10,000 sheet under the NN environment.

In Comparative Example 2, in which the stripping treatment was conducted by blowing saturated steam alone, the TVOC value was high as 343 ppm, and the number of paper sheets continuously printed up to occurrence of fog was 6,000 sheets under the HH environment and 9,000 sheet under the NN environment.

On the other hand, in Examples 1 to 3, in which the stripping treatment was conducted by using the inert gas and saturated steam in combination, the TVOC value was low as at most 150 ppm, printing durability under both HH environment NN environment was excellent, and no vertical stripe occurred.

INDUSTRIAL APPLICABILITY

The polymerized toners obtained by the production process according to the present invention can be used as developers in image forming apparatus of the electrophotographic system, such as facsimiles, copying machines and printers.

The invention claimed is:

1. A process for producing a polymerized toner, comprising Production Step 1 of producing polymer particles, including a step of polymerizing a polymerizable monomer composition containing a colorant and a polymerizable monomer in the presence of a polymerization initiator in an aqueous dispersion medium; Stripping Treatment Step 2 of subjecting a dispersion containing the polymer particles to a stripping treatment to remove volatile organic components including an unreacted polymerizable monomer; and Collecting Step 3 of collecting the polymer particles from the dispersion after the stripping treatment, wherein in Stripping Treatment 2, (1) the dispersion containing the polymer particles is introduced into an evaporator, (2) the stripping treatment is conducted by a method, in which a gas is blown into the dispersion within the evaporator to discharge the volatile organic components including the unreacted polymerizable monomer out of the evaporator concomitantly with the gas, and (3) both inert gas and saturated steam are used in combination as the gas blown into the dispersion, wherein (i) the flow rate of the inert gas blown into the dispersion is controlled within a range of 0.05 to 4 L/(hr·kg), wherein the flow rate of the inert gas is a flow rate per kg of the polymer contained in the dispersion, (ii) the flow rate of the saturated steam blown into the dispersion is controlled within a range of 0.05 to 0.8 kg/(hr·kg), wherein the flow rate of the saturated steam is a flow rate per kg of the polymer contained in the dispersion, (iii) the pressure of a vapor phase within the evaporator is kept within a range of 5 to 80 kPa.

2. The production process according to claim 1, wherein in Stripping Treatment Step 2, the stripping treatment is conducted within an evaporator, which is equipped with a non-contact type bubble level meter at an upper portion thereof, the level of a bubble layer generated on the liquid level of the dispersion is detected by the non-contact type level meter during the stripping treatment, and stripping treatment conditions including the amounts of the gasses blown are controlled on the basis of the level information of the bubble layer detected.

3. The production process according to claim 1, wherein in Stripping Treatment Step 2, the temperature of the dispersion within the evaporator is kept within a range not lower than the glass transition temperature of the polymer component forming the polymer particles, but lower than 100° C.

4. The production process according to claim 1, wherein in Stripping Treatment Step 2, the temperature of the inert gas blown into the dispersion is controlled within a range of 50 to 100° C.

5. The production process according to claim 1, wherein in Stripping Treatment Step 2, the temperature of the saturated steam blown into the dispersion is controlled within a range of 90 to 180° C.

6. The production process according to claim 1, wherein in Stripping Treatment Step 2, the inert gas and saturated steam are blown into the dispersion as independent separate flows.

7. The production process according to claim 1, wherein in Stripping Treatment Step 2, the flows of the inert gas and saturated steam are put together and blown into the dispersion as one flow.

8. The production process according to claim 1, wherein in Stripping Treatment Step 2, a defoaming agent is added to the dispersion containing the polymer particles to conduct the stripping treatment.

9. The production process according to claim 8, wherein the defoaming agent is a non-silicone type defoaming agent.

10. The production process according to claim 1, wherein in Production Step 1, an organic peroxide having a molecular weight of 90 to 205 and a purity of at least 90% is used as the polymerization initiator.

11. The production process according to claim 10, wherein the organic peroxide is non-aromatic peroxyester represented by the following formula (1):

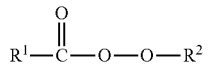

(1)

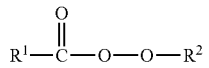

(1)

(in the formula, $R^1$ is an alkyl group having at most 8 carbon atoms, and $R^2$ is an alkyl group having at most 8 carbon atoms).

12. The production process according to claim 1, wherein in Collecting Step 3, polymer particles, in which the total content of the volatile organic components including the unreacted polymerizable monomer is at most 150 ppm, are collected.

* * * * *